US005320038A

United States Patent [19]

Fischer

[11] Patent Number: 5,320,038

[45] Date of Patent: Jun. 14, 1994

[54] METHOD AND APPARATUS FOR ADJUSTING PRINTING UNIT CYLINDERS

[75] Inventor: Christian M. M. Fischer, Marktheidenfeld, Fed. Rep. of Germany

[73] Assignee: Koenig & Bauer Aktiengesellschaft, Wurzburg, Fed. Rep. of Germany

[21] Appl. No.: 941,684

[22] Filed: Sep. 8, 1992

[30] Foreign Application Priority Data

Sep. 9, 1991 [DE] Fed. Rep. of Germany ..... 4129840

[51] Int. Cl.[5] ..... B41F 5/12; B41F 7/12

[52] U.S. Cl. ..... 101/177; 101/180

[58] Field of Search ..... 101/177, 178, 179, 180, 101/182, 184, 185, 220, 221

[56] References Cited

FOREIGN PATENT DOCUMENTS 2736175 8/1977 Fed. Rep. of Germany .

1203968 9/1970 United Kingdom ..... 101/177

*Primary Examiner*—J. Reed Fisher

*Attorney, Agent, or Firm*—Jones, Tullar & Cooper

[57] ABSTRACT

Several cylinders in a multiple cylinder printing press are supported in eccentric bushings so that they can be moved into and out of contact with cooperating cylinders. A force can be applied to these cylinders by rotating the eccentric bushings. The total resultant force will be applied in a direction away from the cylinder or cylinders into which the movable cylinder has been brought into contact.

4 Claims, 3 Drawing Sheets

METHOD AND APPARATUS FOR ADJUSTING PRINTING UNIT CYLINDERS

FIELD OF THE INVENTION

The present invention is directed generally to a method and apparatus for adjusting printing unit cylinders. More particularly, the present invention is directed to a method and apparatus for adjusting eccentric bushings for printing unit cylinders. Most specifically, the present invention is directed to a method and apparatus for adjusting eccentric bushings for printing unit cylinders of offset rotary presses. The cylinders being adjusted are capable of being moved into or out of contact with one or more cooperating cylinders. The impression forces applied by the other cylinder or cylinders, and the weight of the cylinder being adjusted are counteracted by application of forces to the eccentric bushing to provide a resultant force which acts in the same direction as the result of the impression forces on the cylinder.

DESCRIPTION OF THE PRIOR ART

It is very important in virtually all rotary printing presses and is especially important in offset rotary printing presses that all of the various cooperating elements, such as gears and cylinders, as well as cylinder supports be manufactured and mounted with a high degree of precision. If this high degree of precision is not maintained, various printing errors and inaccuracies will occur. The resulting misprinted sheets may exhibit streaks caused by the gears or rollers, streaks caused by the channels in the peripheral surface of the cylinders, or even the especially feared ghosting effect in which single dots have ghost images, comma-shaped elongations, shadows, or dot enlargements.

One generally well known procedure to ensure cylinder alignment and proper bearing pressure between cylinders is to attach bearer rings to the ends of the cylinders. These bearer or roller rings are frequently applied to the end faces of the impression, blanket, or plate cylinders of a rotary press. These bearer or roller rings are usually steel rings which have been hardened and then ground and mounted on the cylinders in as precise a manner as possible. The bearer rings may be directly mounted to the end faces of the plate, impression, or blanket cylinders or may be secured by way of flanges to these cylinders. During the printing operation, the bearer rings of cooperating cylinders are in rolling contact with each other and are forced against each other with a large amount of force. They stiffen the entire printing unit due to the preload that is applied to them. These bearer rings dampen cylinder oscillations and thus cause a smoother running of the printing machine. They also result in the elimination of non-smooth cylinder running which is created by the channel in the periphery of one cylinder being in contact or non-contact with the periphery of its cooperating cylinder. These channels are apt to cause marks on the sheet being printed since the cylinders tend to move closer together when the channel of one cylinder rolls onto the other cylinder and then move apart when the channel roll off other cylinder. The use of bearer rings prevents one cylinder from moving with respect to the other cylinder and thus avoids the formation of marks on the printed sheet.

A limitation created by the use of bearer rings is that an adjustment of the distance between cooperating cylinders is not possible to accomplish. As a result, the thickness of the coverings on the cooperating cylinders has to be as precise as possible so that the correct impression pressure will be maintained. In the situation where the length of the image being printed is to be changed, it will be necessary to secure a new plate covering to the surface of one of the cylinders. Because of the fixed cylinder distance, this change in the plate covering of one cylinder requires a change in the plate covering on the blanket cylinder as well, even if it is not desirable to effect such a change. In a similar manner, if the covering on the blanket cylinder has to be changed for any reason, the unavoidable consequence is that the plate cylinder circumference is changed so that what was previously a correct printing length may now be worsened.

In the German published, unexamined patent specification No. 27 36 175 there is disclosed a printing unit for an offset rotary printing press which functions without the use of bearer rings. A preload of the printing cylinders for the printing units for two adjacent printing press cylinders is effected on the cylinder journals through bearings by use of compression springs or by active cylinders that can be provided with a fluid under pressure. A limitation of this prior art printing unit is that various additional energy accumulating devices, in the form of springs or active cylinders which have to be provided with a fluid under pressure are required.

It will be apparent that a need exists for a method and apparatus for adjusting printing unit cylinders which overcomes the limitations of the prior art devices. The method and apparatus of the present invention provides such a device and procedure and is a significant advance over the prior art.

SUMMARY OF THE INVENTION

It is an object of the present invention to provide a method and apparatus for adjusting printing unit cylinders.

Another object of the present invention is to provide a method and apparatus for adjusting eccentric bushings for printing unit cylinders.

A further object of the present invention is to provide a method and apparatus for adjusting eccentric bushings for printing unit cylinders in an offset rotary press.

Still another object of the present invention is to provide a method and apparatus for adjusting printing unit cylinders which can be moved into and out of printing engagement.

Yet a further object of the present invention is to provide a method and apparatus for adjusting printing unit cylinders which will maintain printing quality.

As will be discussed in greater detail in the description of the preferred embodiment which is set forth subsequently, the method and apparatus for adjusting printing unit cylinders in accordance with the present invention utilizes a plurality of cylinders that are supported by eccentric bushings in the side frames of the press assembly. These eccentric bushings support the journals of selected ones of the cylinders. The eccentric bushings can be rotated by double acting cylinders whose piston rods are connected, through connecting rods to flanges on the eccentric bushings. Counter bearing devices are also connected to the eccentric bushings. Forces are applied by the double acting cylinders and the counter bearing devices which, in cooperation with the weight of the cylinder and the impression forces applied to it by the cylinder or cylinders with which it is engageable, result in a total resultant force that results in a smooth running of the printing press in a manner which produces quality printed products.

A particular advantage of the method and apparatus for adjusting printing unit cylinders in accordance with the present invention is that the play in the bearing bushings for the cylinders is eliminated without the use of bearer or roller rings. The forces applied to the flanges of the eccentric bushings by the double acting cylinders and by the counter bearing devices are applied in the proper direction and with the proper amount of force so that this play in the bearing bushings is effectively eliminated. The elimination of this play also eliminates the oscillations which previously resulted when the channel in the surface of one cylinder passed across the surface of the cooperating cylinder.

The method and apparatus for adjusting printing unit cylinders in accordance with the present invention overcomes the limitations of the prior art and provides an assembly which provides quality printed products while eliminating the need for bearer rings. The method and apparatus in accordance with the present invention is a substantial advance in the art.

BRIEF DESCRIPTION OF THE DRAWINGS

While the novel features of the method and apparatus for adjusting printing unit cylinders in accordance with the present invention are set forth with particularity in the appended claims, a full and complete understanding of the invention may be had by referring to the detailed description of the preferred embodiment which is set forth subsequently, and as illustrated in the accompanying drawings in which:

DESCRIPTION OF THE PREFERRED EMBODIMENT

Figure 1:
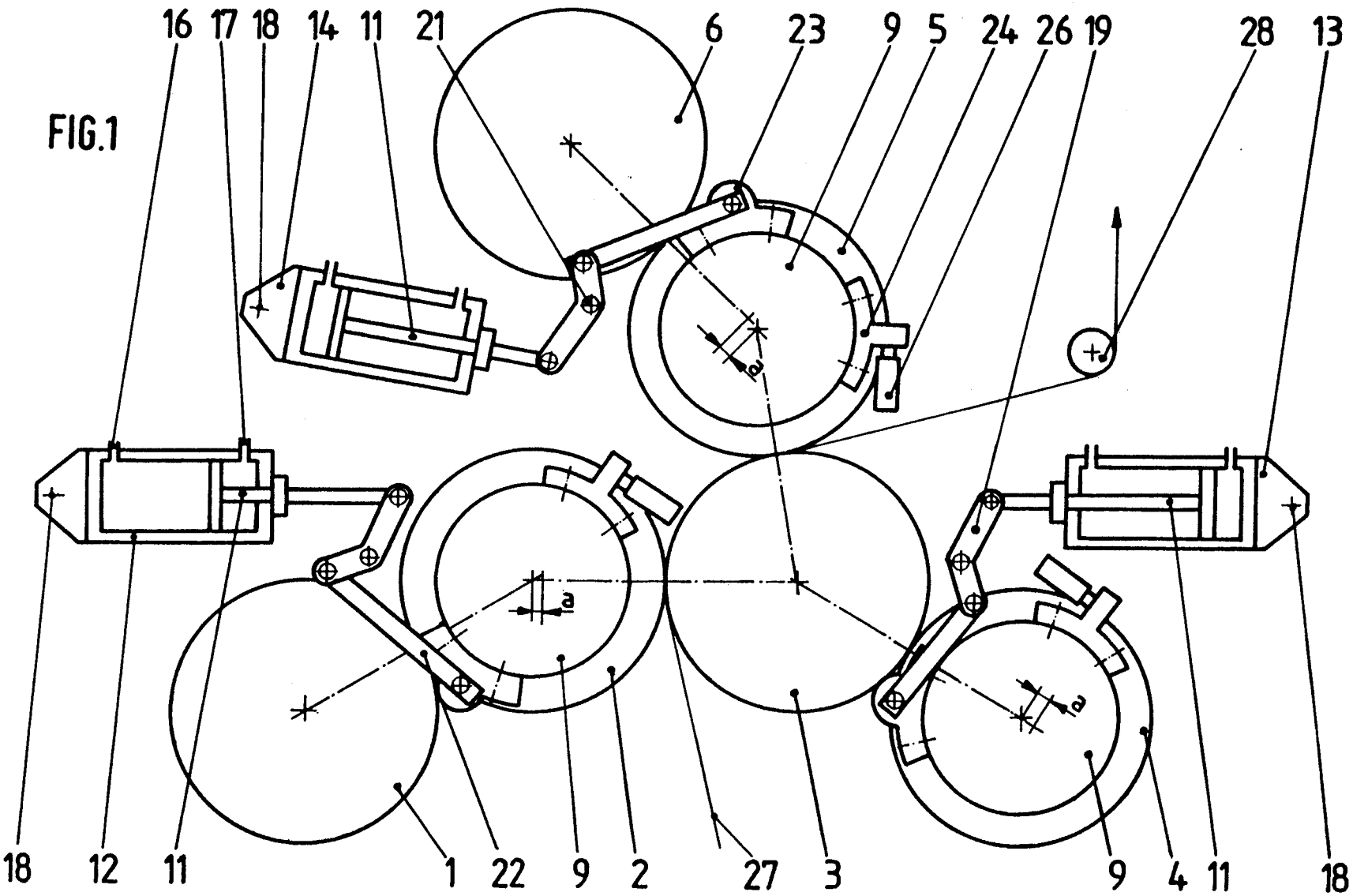
FIG. 1 is a schematic side elevation view of a printing unit having a plurality of cylinders in accordance with the present invention.

Referring initially to FIG. 1, there may be seen a somewhat schematic depiction of a printing unit utilizing the method and apparatus for adjusting printing unit cylinders in accordance with the present invention. The printing unit depicted in FIG. 1 is a generally Y-type offset rotary press shown with a plurality of cooperating printing cylinders 1–6. In the depicted configuration, cylinders 1, 4 and 6 are formed cylinders while cylinders 2, 3 and 5 are blanket cylinders.

Figure 2:
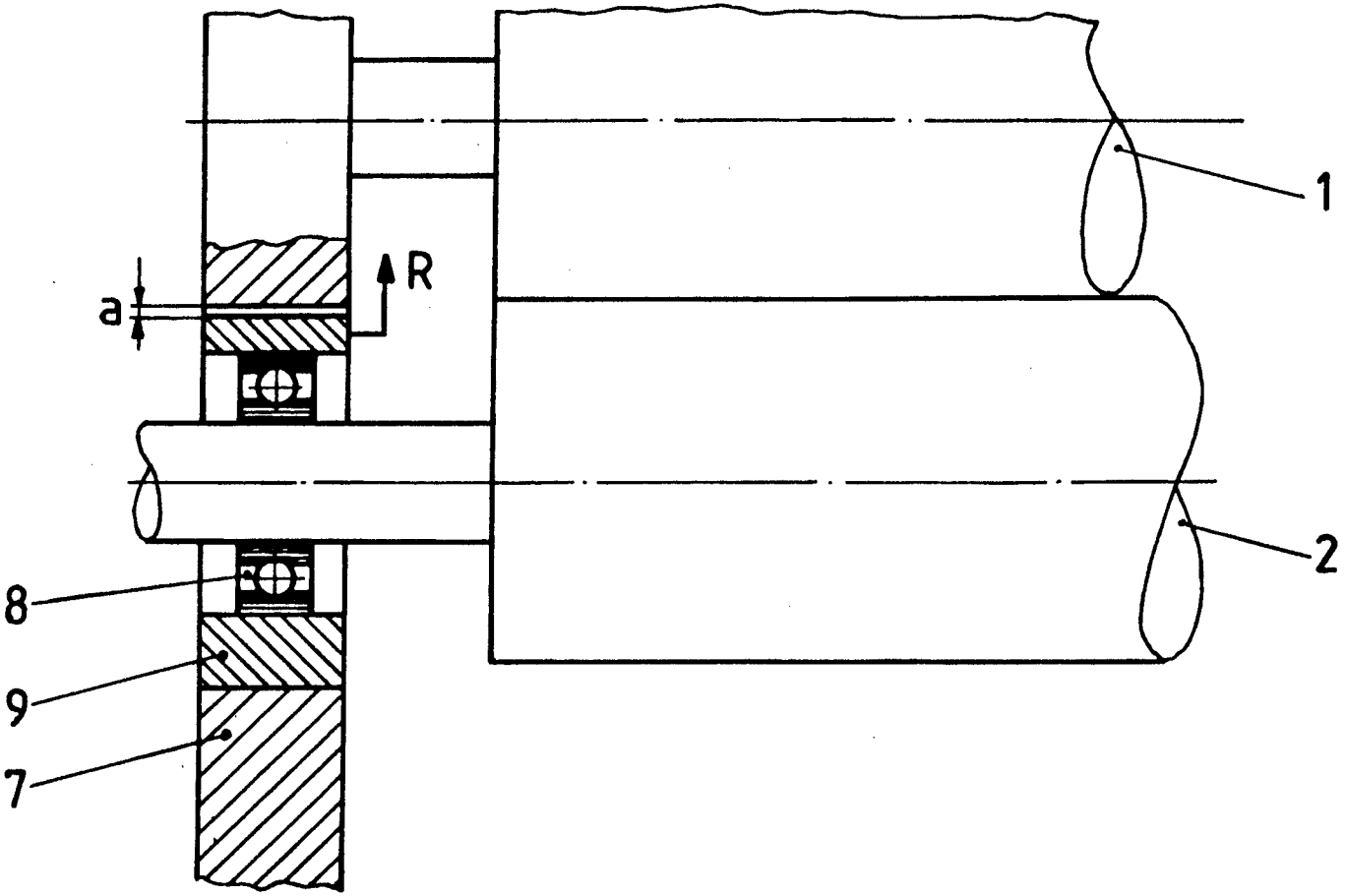
FIG. 2 is a front elevation view, partly in cross-section of an impression cylinder which can be moved into and out of engagement with a cooperating cylinder.

Each of the printing unit cylinders 1–6 is supported by its respective cylinder journals, which are symbolically depicted by crossed lines in the center of each cylinder shown in FIG. 1, in spaced side frames 7 of the printing press machine. As may be seen more specifically in FIG. 2 wherein one such side frame 7 is shown, the cylinders 1, 3 and 6 are supported by their shaft ends on both sides in the side frames in antifriction bearings. These supports for the cylinders 1, 3 and 6 have very limited bearing play. This means that the printing unit cylinders 1, 3 and 6 are essentially fixed in their positions in the side frames 7. The printing unit cylinders 2, 4 and 5 are supported at both of these ends in anti-friction bearings 8, which, as may be seen in FIG. 2, are supported, in turn, in eccentric bushings 9 in the machine side frames. The bearing play "a" of each of these eccentric bushings, as depicted in FIG. 1 is about 0.05 mm for each eccentric bushing 9.

The various cylinders 1–6 in the offset rotary printing press can be brought into and out of engagement, or can be thrown-on or off each other in the following ways: cylinder 2 can be brought into or out of contact with cylinders 1 and 3 cylinder 4 can be moved relative to cylinder 3, and cylinder 5 can be moved with respect to cylinders 3 and 6. This movement of the cylinders 2, 4, and 5 with respect to the cylinders 1, 3 and 6 is accomplished by rotation of the eccentric bushings 9.

In accordance with the method and apparatus for adjusting printing unit cylinders of the present invention, the printing unit cylinders 2, 4 and 5 which are supported by eccentric bushings 9 are provided with their preloads which will compensate for the play "a" of the eccentric bushings 9 by use of a system of levers which are connected to piston rods 11 of double acting cylinders 12, 15 and 14. As may be seen most clearly in FIG. 1, each of the double acting cylinders 2, 13 and 14 can be executed as a pneumatically or hydraulically activated cylinder. Each of these double acting cylinders 2, 3 and 14 is provided with an opening 16 and 17 at either end of the cylinder and thus on both sides of the piston carried by piston rod 11 in each cylinder 12, 13 and 14. These openings 16 and 17 are connected by suitable fluid flow lines which are not specifically shown, to a source of pressurized fluid medium. Thus each piston can be moved either way in its cylinder. Each of the double acting cylinders 12, 13 and 14 is secured to a machine side frame 7 by an arrangement of screws or bolts which are depicted generally at 18.

Referring again primarily to FIG. 1, each piston rod 11 is hingedly connected at its free end to a first end of an angular lever 19 which is pivotably attached to the side frame 7 of the printing press by suitable means at a point 21 intermediate its ends. A second end of the angular lever 19 is hingedly connected to a first end of a connecting rod 22. The double acting cylinder 12, 13, or 14, its piston rod and the associated angular lever 19 and connecting rod 22 for each cylinder comprises a force feeding in assembly 20. A second end of the connecting rod 22 of each of the force feeding-in assemblies 20 is hingedly connected to a first flange 23 which is securedly affixed to the corresponding eccentric bushing 9. Further, each of the eccentric bushings 9 for the printing unit cylinders 2, 4, and 5 has a second flange 24 which is securedly affixed to it. This second flange 24 has a nose surface which presses firmly against a frame attached counter bearing 26. This assembly of second flange 24 and frame-fixed counter bearing provides a counterforce feed-in assembly 25. By actuating the double acting cylinders 12–14, the printing unit cylinders 2, 4 and 5 can be thrown-on to the printing unit cylinders 1, 3, or 6 so that a paper web 27 which passes through the offset rotary press can be printed two times on its left side and one time on its right side with a high degree of quality. The printed paper web 27 then leaves the printing unit over the paper web guide rollers 28.

Figure 3:
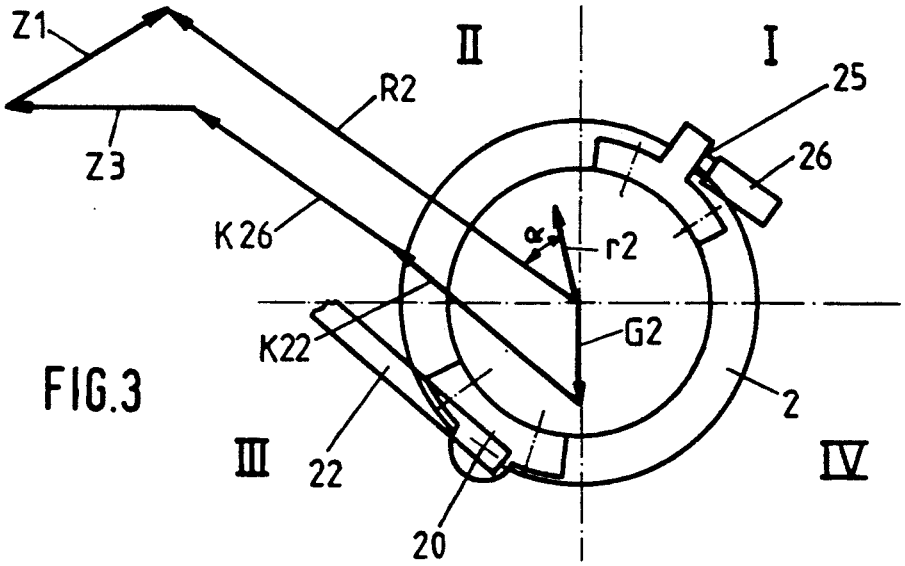
FIG. 3 is a force diagram of the forces acting on one of the blanket cylinders of FIG. 1.
Figure 4:
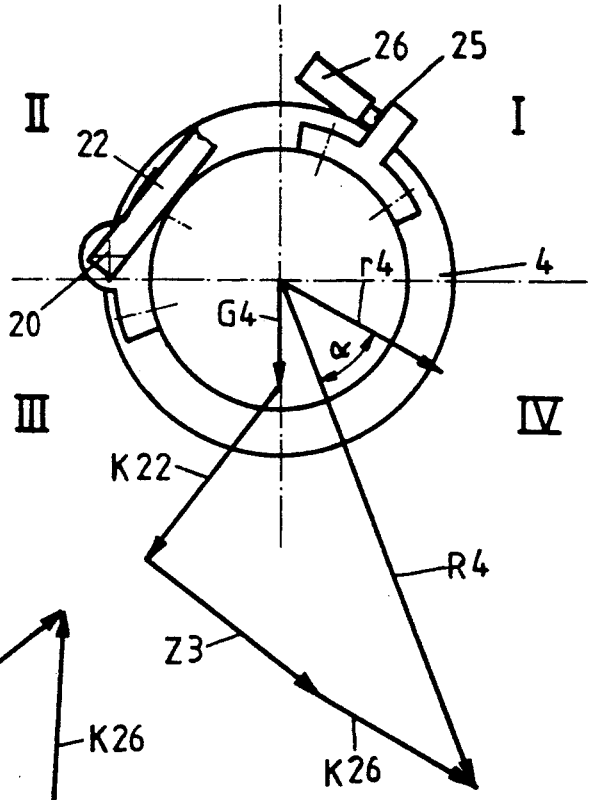
FIG. 4 is a force diagram of the forces acting on one of the formed cylinders of FIG. 1.
Figure 5:
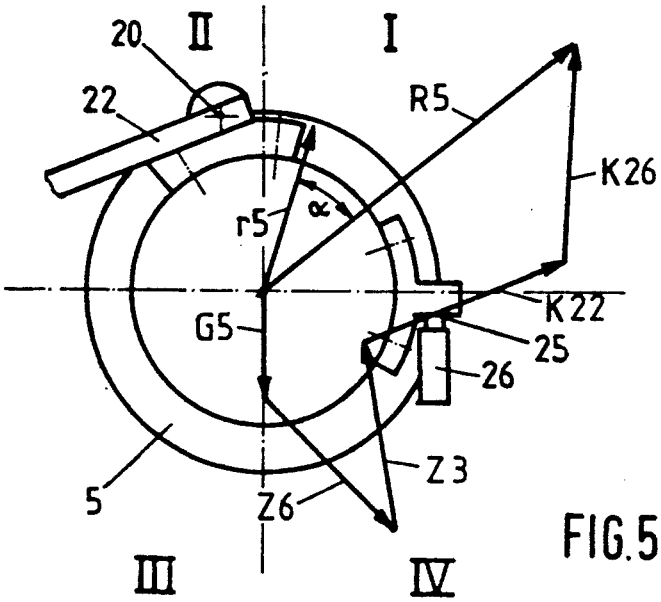
FIG. 5 is a force diagram of the forces acting on another one of the blanket cylinders of FIG. 1.

Turning now primarily to FIGS. 3–5 which are depictions of force diagrams that show the forces applied to the various shiftable printing unit cylinders 2, 4, and 5, the method and apparatus for adjusting printing unit cylinders will be discussed in more detail. In these several drawing figures, the cylinders are divided into four quadrants, I, II, III and IV. These quadrants refer to a rectangular system of coordinates with quadrants which are limited by the X- and Y-axis. The point of intersection of the X and Y axes is on the axis of rotation of the printing unit cylinders. The quadrants go counterclockwise in their designation I to IV and begin with quadrant I.: X-axis and Y-axis positive; Quadrant II.: X-axis negative, Y-axis positive; Quadrant III.: X-axis and Y-axis negative; Quadrant IV.: X-axis positive, Y-axis negative.

Referring initially to FIG. 3 there is depicted the arrangement of forces on the blanket cylinder 2 which has been thrown-on or brought into contact with the formed cylinder 1 and the blanket cylinder 3, as was discussed previously. A total resultant force R2 is directed at an angle $\alpha$ which is $\pm 45°$ to a resultant force r2 that is the result of the two impression forces Z1 and Z2 which are applied against blanket cylinder 2 by the engagement with it of the adjacent printing unit cylinders 1 and 3. It can be seen that this total resilient force R2 is of a greater magnitude and is in the same generally direction as the resultant force r2 of the two impression forces Z1 and Z3.

The weight G2 of the blanket cylinder 2, the forces Z1 and Z3 of the adjacent printing unit cylinders i and 3, as well as the desired direction of the total resultant R2 determine the position and the intensity of the forces K22 of the double acting cylinder 12 or by the counter bearing 26 of the blanket cylinder 2 in the machine frame 7. The forces depicted in FIG. 3 may be as follows: Z1=650 daN, Z3=650 daN, G2=375 daN, R2=1.700 daN, K22=840 daN, K26=840 daN. The angle $\alpha$ is about 25° . The total resultant force R2 is always in the direction of the resultant force r2 of the adjacent printing unit cylinders 1, 3. This force direction guarantees a smooth run of the printing unit cylinders, during operating condition and even with passing channels. From FIG. 3 it can also be seen that the counter bearing 26 is arranged, together with the counterforce feed-in 25, in quadrant I. and that the connecting rod 22 together with the force feed-in 20 are in quadrant III. The resultant forces r2 and R2 are between, which means in quadrant II, these forces 20 and 25 which are applied to the flanges of the eccentric bushing 9.

Turning now to FIG. 4, there is depicted a similar force diagram for the formed cylinder 4. As can be seen in FIG. 1, this formed cylinder is in contact only with the blanket cylinder 3 so that only one impression force Z3 from the blanket cylinder 3 is applied against formed cylinder 4 when this formed cylinder is thrown-on or brought into positive contact with the blanket cylinder 3. In this force diagram, the total resultant force R4 is formed by the application of the forces K22 and K26 so that the total resultant force R4 and the resultant force r4 of the impression force Z3 from the blanket cylinder 3 are directed generally in the same direction in quadrant IV with the angle $\alpha$ between the total resultant R4 and the impression force resultant r4 being about $\pm 45°$ . The weight G4 of the formed cylinder, the impression force Z3 of the adjacent printing unit cylinder 3, as well as the desired direction of the total resultant R4 determine the position and intensity of the forces K22 and K26, which are applied by the connecting rod 22 of the double acting cylinder 13 or by the counter bearing 26 of the formed cylinder 4 in the machine frame 7. According to FIG. 4, the forces can be as follows: Z3 =650 daN, G4=375 daN, R4=1.850 daN, K22=760 daN, K26=760 daN. The angle $\alpha$ is about 39°. Further, it can be seen from FIG. 4, that the counter bearing 26 is in quadrant I. and the connecting rod 22 and the force feed-in 20 are together in quadrant II., the resultants r4 and R4 being, however, between them, which means in quadrant IV. This is similar to FIG. 3 in that the total resultant force R4 is directed away from the cylinder which is in contact with the movable cylinder; blanket cylinder 2 in FIG. 3 and formed cylinder 4 in FIG. 4.

Now referring to FIG. 5, there is depicted the force diagram for blanket cylinder 5. As can be seen in FIG. 1, this blanket cylinder is movable into contact with blanket cylinder 3 and forme cylinder 6. The total resultant force R5 is directed out in the first quadrant at an angle $\alpha$ of $\pm 45°$ to the resultant force r5 which is the resultant of the impression forces Z3 and Z6 that are applied against blanket cylinder 5 by the adjacent blanket cylinder 3 and the forme cylinder 6. The weight G5 of the blanket cylinder 5, the forces Z3 and Z6 of the adjacent printing unit cylinders 3 and 6, as well as the desired direction of the total resultant R5 determine the position and the intensity of the forces K22 and K26, which are applied by the connecting rod 22 of the double acting cylinder 14 or by the counter bearing 26 of the blanket cylinder 5 in the machine frame 7. The forces according to FIG. 5 can be as follows: Z3=650 daN, Z6=650 daN, G5=375 daN, R5=1.350 daN, K22=760 daN, K26=760 daN. The angle $\alpha$ is about 11° . As seen in FIG. 5, the counter bearing 26 is in quadrant IV and the connecting rod 22 and the force feed-in 20 are both in quadrant II. The resultant force r5 from the impression forces and the total resultant force R5 are directed away from the two cylinders 3 and 6 and are in the quadrant between quadrants II and IV; i.e. in quadrant I.

In the printing press assembly shown in FIG. 1, it would be possible to omit the printing cylinders 5 and 6 and to displace cylinders 1–4 by 180° as printing cylinders 1'–4' which would then take the place of eliminated cylinders 5 and 6. The forces in this resulting modified printing press assembly are essentially the same as those shown in FIGS. 3 and 4 with the difference being that the resultant force r2' and the total resultant force R2' for the inverted blanket cylinder 2' are in quadrant IV and the resultant force r4' and the total resultant force R4' for the inverted cylinder 4 are in quadrant II.

It will be seen that the method and apparatus for adjusting printing unit cylinders in accordance with the present invention have been fully and completely set forth hereinabove. It will be apparent to one of skill in the art that a number of changes in, for example the overall sizes of the cylinders, the type of pressure medium used in the double acting cylinders, the types of antifriction bearings and the like can be made without departing from the true spirit and scope of the present invention which is accordingly to be limited only by the following claims.

I claim:

1. An apparatus for adjusting a movable printing unit cylinder in a rotary printing press, said apparatus comprising:

a printing press having spaced machine frames;

at least a first movable printing unit cylinder rototably supported in bearings in said machine frames;

eccentric bushings in said machine frame, said eccentric bushing supporting said bearings for said first movable printing unit cylinder;

at least first and second stationary printing unit cylinders supported in said machine frames in engagement with said first movable printing unit cylinder, said first movable printing unit cylinder being movable with respect to said first and second stationary cylinders, said first and second stationary cylinders applying first and second impression forces to said first movable cylinder, said first and second impression forces applying a resultant impression force to said first movable cylinder in a resultant force direction;

a force feed-in assembly connected to each of said eccentric bushings and a counterfore feed-in assembly connected to each of said eccentric bushings; and means for applying a rotational movement to each of said eccentric bushings through said force feed-in assemblies to apply a pressure force from at least one of said first and second stationary cylinders to said first movable cylinder in a pressure force direction, said pressure force and said resultant impression force cooperating to apply a first total resultant force to said first movable cylinder, said first total resultant force having a total resultant force direction which is directed at an angle of 0° to 45° with respect to said resultant impression force direction.

2. The apparatus of claim 1 further including a second movable cylinder, said second movable cylinder being engageable with said second stationary cylinder with second total resultant force.

3. The apparatus of claim 2 further including a third movable cylinder engageable with said second stationary cylinder and a third stationary cylinder engageable with said third movable cylinder, said third movable cylinder being engageable with said second stationary cylinder with a third total resultant force.

4. The apparatus of claim 1 wherein said means for applying a rotational movement to said eccentric bushings includes a double acting cylinder engageable with flanges on said eccentric bushings.

* * * * *